US005371912A

United States Patent [19]

Hall

[11] Patent Number: 5,371,912

[45] Date of Patent: Dec. 13, 1994

[54] FLOOR AND BASEBOARD CLEANING MACHINE

[76] Inventor: Stuart A. Hall, 1104 Quail Dr., Greensboro, N.C. 27408

[21] Appl. No.: 127,044

[22] Filed: Sep. 27, 1993

[51] Int. Cl.[5] ..... A47L 11/12

[52] U.S. Cl. ..... 15/98; 15/50.1

[58] Field of Search ..... 15/49.1, 50.1, 50.2, 15/52.2, 98, 374, 380, 144.2; 51/175, 170 TL

[56] References Cited

U.S. PATENT DOCUMENTS

| | | | |
|---|---|---|---|
| 687,795 | 12/1901 | Tulloch | 51/175 |
| 3,058,136 | 10/1962 | Rachlin | 15/50.1 |
| 3,327,338 | 6/1967 | Young | 15/98 |
| 3,366,288 | 1/1968 | Goldschein | 15/50.1 |
| 3,533,120 | 10/1970 | Mercado | 15/50.1 |
| 3,731,334 | 5/1973 | Carbonell | 15/50.1 |
| 4,524,477 | 6/1985 | Williams et al. | 15/50.1 |
| 4,606,092 | 8/1986 | Henning | 15/322 |
| 4,691,403 | 9/1987 | Scharf | 15/114 |
| 4,724,567 | 2/1988 | Rones | 15/98 |
| 4,783,872 | 11/1988 | Burhoe | 15/98 |
| 5,054,245 | 10/1991 | Coty | 51/170 |
| 5,287,583 | 2/1994 | Lilja | 15/144.2 |

*Primary Examiner*—Edward L. Roberts

[57] ABSTRACT

An electric floor and baseboard cleaning machine includes a motor assembly attached to a medium frame in which the movement thereof is adjustable for either straight line or circular motion. The medium frame has a fixed and pivotal sections and the pivotal sections can be manually adjusted from a vertical to a horizontal position. For cleaning vertical baseboards the pivotal section is secured in an upright posture and when used to clean floors it is affixed in a downward or horizontal position. Cleaning medium such as a non-woven pads are affixed to the medium frame and two such pads can be used, one for the pivotal frame section and the other for the fixed frame section. The cleaning machine provides an electric pump and liquid reservoir for directing a cleaning or other fluid as desired to a spray nozzle located near the cleaning medium.

15 Claims, 2 Drawing Sheets

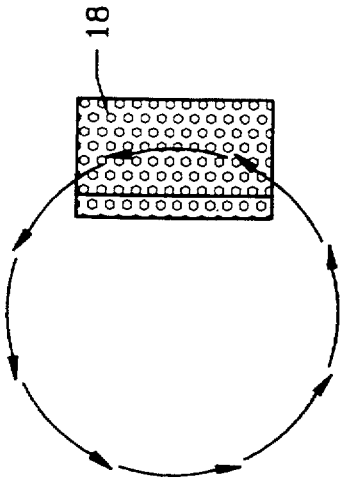
FIG. 5
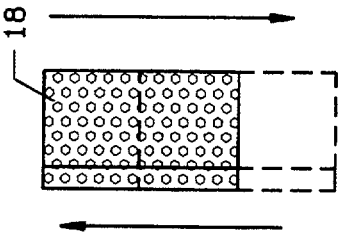
FIG. 6
FIG. 7
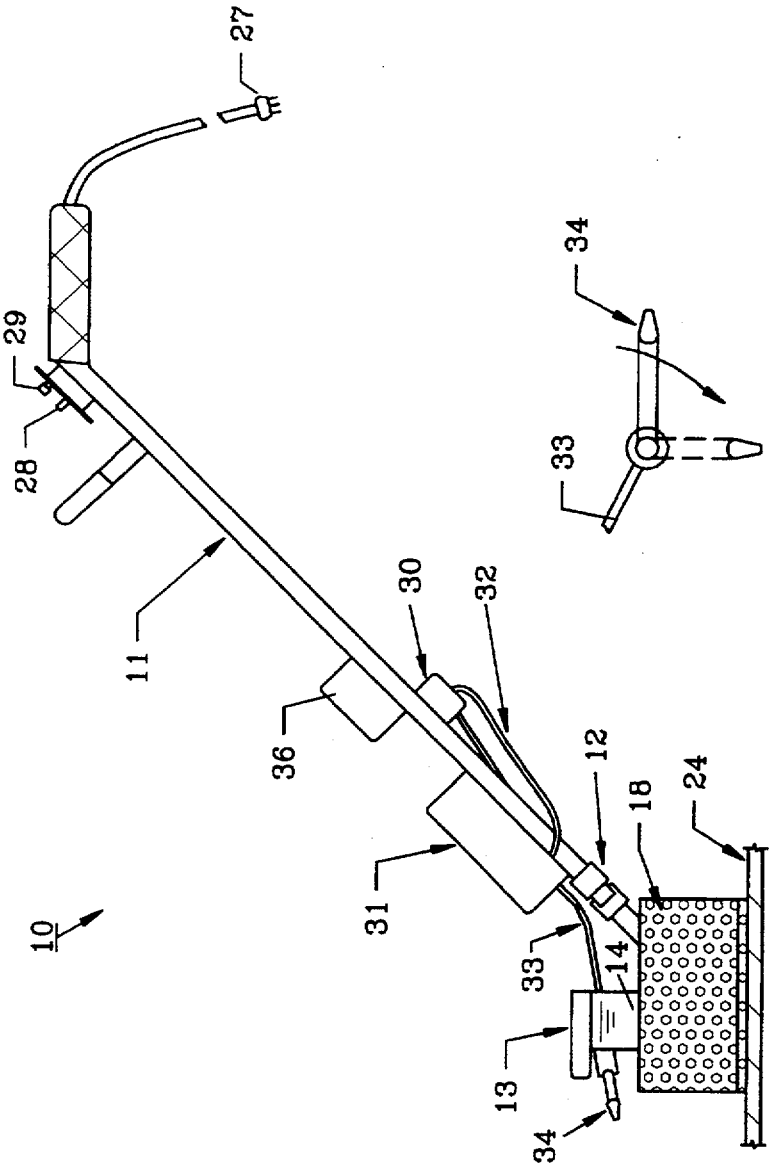
FIG. 1

FLOOR AND BASEBOARD CLEANING MACHINE

BACKGROUND OF THE INVENTION

1. Field of the Invention

The invention herein pertains to floor cleaning machines and particularly to floor and baseboard cleaning machines which are electrically powered.

2. Description of the Prior Art and Objectives of the Invention

Rotary and other floor cleaning machines have been used in the past which utilize non-woven fabric disks for wax application and removal, cleaning, scouring, polishing and other maintenance activities. In commercial and institutional maintenance, baseboards become soiled and must be constantly hand cleaned by custodians or other workers. Baseboard cleaning is particularly important in medical laboratories, food handling areas, operating rooms and other critical locations requiring the utmost in sanitation. Various baseboard cleaning devices have been devised in the past such as shown in U.S. Pat. Nos. 4,691,403 and 4,606,092. While such devices are useful in certain situations, such previous devices are limited in their function and adaptability and the particular need for a versatile machine which will operate in a relatively confined space has not been satisfied until the present invention was conceived.

Thus, with the problems and disadvantages associated with prior art cleaning equipment as mentioned above, the present invention was developed and one of its objectives is to provide a floor and baseboard cleaning machine which is relatively easy to operate by unskilled personnel.

It is another objective of the present invention to provide a floor and baseboard cleaning machine which includes a handle with an electric motor assembly pivotally attached thereto with a frame for attaching cleaning medium such as non-woven pads.

It is yet another objective of the present invention to provide a floor and baseboard cleaning machine which includes a reservoir for containing a liquid cleaner which can be sprayed through a rotatable nozzle onto the floor and/or baseboard.

It is still another objective of the present invention to provide a floor and baseboard cleaning machine in which the motion of the cleaning medium can be adjusted for either a straight line or circular cleaning motion at variable speeds.

It is a further objective of the present invention to provide a floor and baseboard cleaning machine which includes a medium frame driven by the motor assembly with the cleaning medium releasably attached thereto.

It is yet still another objective of the present invention to provide a floor and baseboard cleaning machine in which the medium frame includes a pivotal section which can be raised to a vertical posture for cleaning baseboards and which can be lowered to a horizontal posture for cleaning floors.

Various other objectives and advantages of the present invention become apparent to those skilled in the art as a more detailed presentation is set forth below.

SUMMARY OF THE INVENTION

The aforesaid and other objectives are realized by providing a floor and baseboard cleaning machine which includes a handle pivotally joined through a universal joint to a motor assembly. The motor assembly includes a fractional horsepower AC motor and a means to drive a cleaning medium frame in either a straight line or circular motion. The cleaning medium frame is attached beneath the motor assembly and includes a pivotal section which can be manually adjusted to an upright vertical posture for cleaning certain baseboards and which can be lowered to a horizontal posture to increase the surface area of the cleaning medium when used for cleaning floors. A spray nozzle is adjustably positioned proximate the cleaning medium for spraying a cleaning or other solution from a reservoir affixed to the handle. An electric pump is attached to the handle and has a control switch or button near the top of the handle. A dial type switch is also provided at the top of the handle for controlling the speed of the motor and thus the speed of the medium frame. The pivotal frame section can be manually adjusted to any of a variety of positions as required, depending on the particular cleaning task and surface encountered. The cleaning medium affixed to the medium frame may consists of two rectangular pads approximately five inches by ten inches and three-quarters of an inch thick formed from a synthetic non-woven material as are conventional in the trade.

BRIEF DESCRIPTION OF THE DRAWINGS

FIG. 1 shows a side elevational view of the floor and baseboard cleaning machine of the invention;

FIG. 5 pictures the circular motion of the cleaning medium;

FIG. 6 illustrates a straight line motion of the cleaning medium; and

FIG. 7 shows the adjustability of the spray nozzle enlarged for clarity.

DESCRIPTION OF THE PREFERRED EMBODIMENT

The preferred form of the invention is shown in FIGS. 1–7 whereby a motor assembly with a medium frame is joined through a universal joint to a handle. The handle includes electrical controls including a motor speed on/off switch to control the speed of the medium movement and also a pump button switch to control the spray of the cleaning solution. A cleaning liquid tank is attached to the handle near the lower end and the tank is in fluid communication with a DC pump also mounted on the handle. As the pump switch is depressed, cleaning fluid is sprayed through rotatable nozzle positioned proximate the medium frame. Conventional non-woven pads are releasably attached to the medium frame which has a fixed and pivotal section. The pivotal section can be manually adjusted and secured to a horizontal, vertical or positioned therebetween for cleaning floors and/or baseboards as desired. The motor assembly is selectably adjustable for either straight line or circular (orbital) motion by setting a lever on the motor assembly. The motor assembly is powered by a 110 v source and the pump is a DC type with built-in transformer.

The medium pads can be releasably exchanged for cleaning, buffing, scouring, waxing or the like and each pad is approximately five inches wide, ten inches long and approximately three-quarters of an inch in thickness and are formed from conventional non-woven synthetic fibers. The spray nozzle which is rotatably affixed to the motor assembly can be turned to any of a variety of positions for spraying either baseboards or floors at the specific angle suitable. The cleaning fluid used herein is a conventional soap and solvent solution as is commercially available although other solutions, disinfectants, wax strippers, waxes as desired may be used.

DETAILED DESCRIPTION OF THE DRAWINGS AND OPERATION OF THE INVENTION

Figure 2:
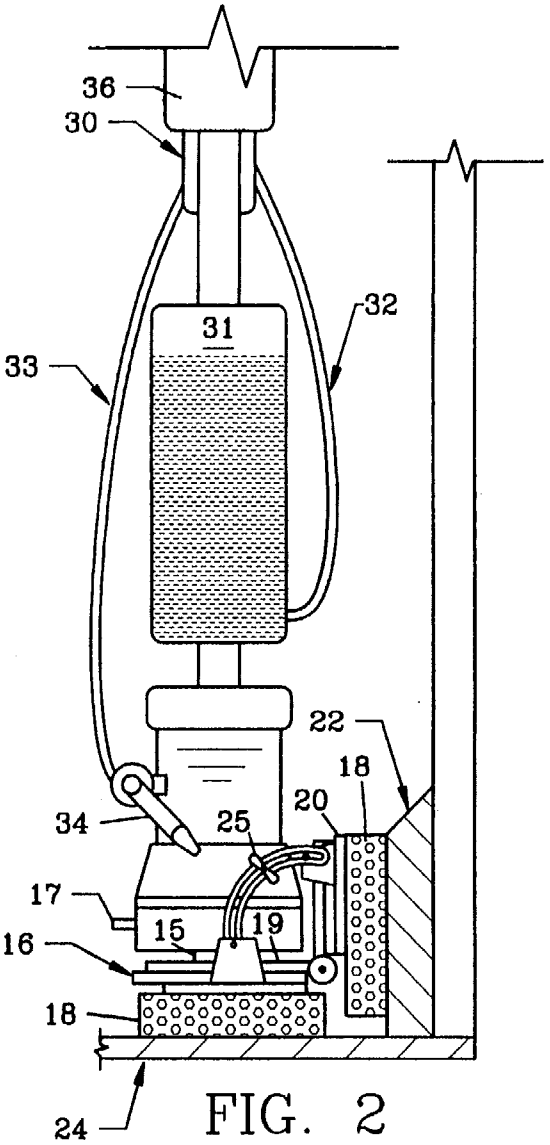
FIG. 2 illustrates an enlarged front view of the motor assembly and cleaning medium pivotal frame section adjusted for cleaning a vertical baseboard.

Turning now to the drawings, for a more detailed description of the invention and its operation, FIG. 1 demonstrates floor and baseboard cleaning machine 10 having a handle 11 joined by universal joint 12 to motor assembly 13. Motor assembly 13 includes electric AC motor 14 and a means 15 for imparting motion to medium frame 16 in the form of a depending stud as shown in FIG. 2. Motion means 15 can be adjusted by lever 17 whereby medium frame 16 will then move in either a circular or straight line direction. Motor assembly 13, motion means 15 and lever 17 are used with conventional orbital sanding machines.

Figure 4:
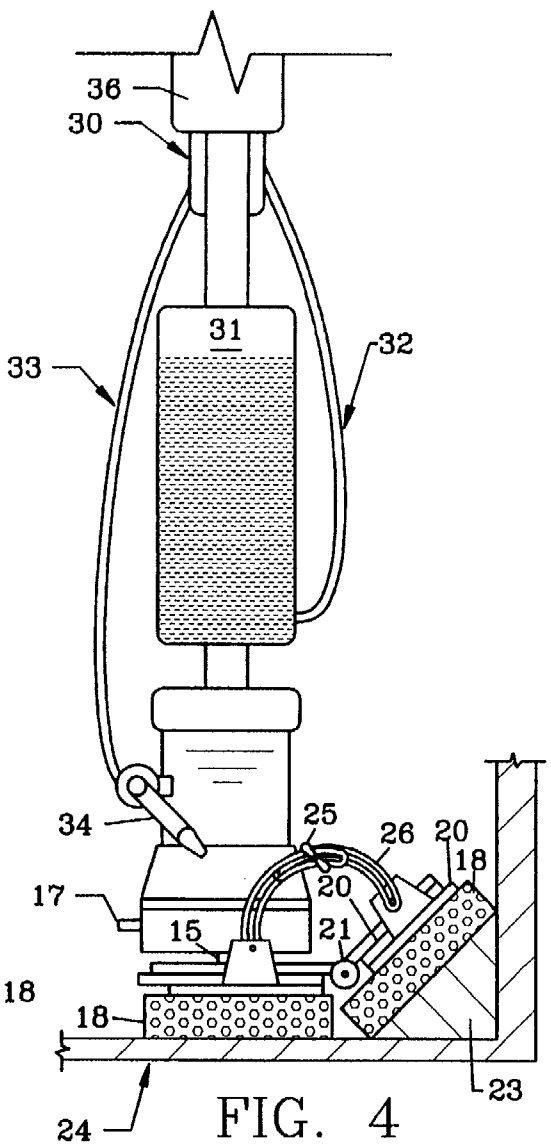
FIG. 4 demonstrates an enlarged front view of the motor assembly with the pivotal section of the medium frame positioned at approximately a forty-five degree angle for cleaning a particular baseboard.
Figure 3:
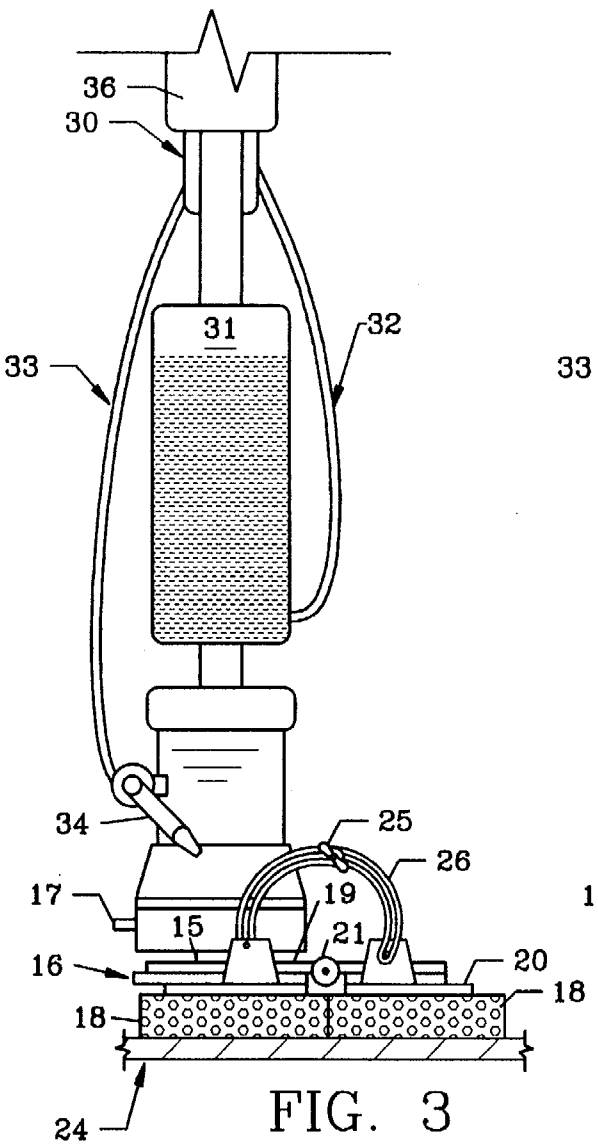
FIG. 3 depicts the pivotal frame section enlarged in a downward or horizontal position for cleaning the floor.

As further shown in FIGS. 1 and 2, cleaning medium 18 is attached to medium frame 16 and medium 18 is shown in the form of a rectangular, non-woven synthetic fiber pad. Such pads come in a variety of grades for scouring, cleaning, polishing, buffing, waxing and the like. As seen in FIGS. 3 and 4, medium frame 16 has a fixed section 19 and pivotal section 20 joined together by hinge 21. Fixed frame section 19 as would be understood is moved by motion means 15 and as shown in FIG. 2 pivotal section 20 can be raised to a vertical posture for scrubbing baseboard 22 or can be adjusted as shown in FIG. 4 for scrubbing baseboard 23 which is positioned at an approximately forty-five degree angle. Also, pivotal frame section 20 can be lowered to a horizontal posture as shown in FIG. 3 to provide a greater medium area for floor cleaning. Pivotal frame section 20 is adjustably affixed by wing nut 25 which tightens against slotted frame arm 26. As would be understood by those skilled in the art, slotted arm 26 and wing nut 25 are but one of a variety of ways to adjust and secure pivotal frame section 20.

To operate floor and baseboard cleaning machine 10, electrical plug 27 as seen in FIG. 1 is connected to a 110 v-AC source and motor speed dial 28 is rotated to one of a variety of positions for speed adjustment of cleaning medium 18. Motor adjustment lever 17 is set for either straight line or circular motion and pivotal frame section 20 is adjusted to a desired position. If, for example when cleaning floor 24, a cleaning solution is required, pump button 29 is depressed which activates D.C. pump 30 connected to transformer 36 which in turn directs cleaning fluid from liquid reservoir 31 through fluid conduit 32, past pump 30, through fluid line 33 through spray nozzle 34. As shown in FIG. 1 spray nozzle 34 is positioned proximate cleaning medium 18 and directs a spray onto floor 24 or baseboard 22 (FIG. 2) as required. Spray nozzle 34 is manually rotatable and can be adjusted to any of a variety of positions for either baseboard or floor spraying. When pump button 29 is released, pump 30 is deactivated and the cleaning spray ceases. Spray nozzle 34 as shown enlarged in FIG. 7 can be rotated to any of a variety of positions shown therein. As earlier explained, motor adjustment lever 17 can be adjusted to provide a circular action of cleaning medium 18 as shown in FIG. 5 or a straight line motion as shown in FIG. 6, depending on the particular cleaning job encountered.

Floor and baseboard cleaning machine 10 as shown in FIG. 1 is extremely versatile and can be adapted for various uses, particularly in areas where space is minimal and cleaning is required under counters, cabinets, or the like where large, bulky machines will not operate efficiently.

The illustrations and examples provided herein are for explanatory purposes and are not intended to limit the scope of the appended claims.

I claim:

1. A floor and baseboard cleaning machine comprising: a handle, a motor assembly, said motor assembly joined to said handle, a medium frame, said medium frame movably attached to said motor assembly, said medium frame comprising a fixed and a pivotal section, said pivotal section hinged to said fixed section, said pivotal section adjustable from a horizontal to a vertical position.

2. The cleaning machine of claim 1 and including an arcuate adjustment arm, said arm attached to said pivotal and said fixed sections.

3. The cleaning machine of claim 1 wherein said motor assembly comprises means to move said medium frame, said moving means connected to said medium frame.

4. The cleaning machine of claim 1 wherein said motor assembly includes an electric motor.

5. The cleaning machine of claim 1 and including a fluid spray assembly, said spray assembly attached to said handle.

6. The cleaning machine of claim 5 wherein said spray assembly includes an electric pump, a switch, said switch connected to said pump, a liquid reservoir, said reservoir in fluid communication with said pump, and a nozzle, said nozzle in fluid communication with said pump whereby said switch will activate said pump and liquid will spray from said reservoir through said nozzle.

7. The cleaning machine of claim 6 wherein said nozzle is positioned proximate said medium frame.

8. The cleaning machine of claim 1 wherein said cleaning medium comprises a pad.

9. The cleaning machine of claim 8 wherein said pad is formed from a non-woven material.

10. Floor and baseboard cleaning apparatus comprising: a motor assembly, a handle, said handle affixed to said motor assembly, a medium frame, said medium frame movably attached to said motor assembly, said medium frame having a fixed section and a pivotal section, said pivotal section hingedly joined to said fixed section, said pivotal section, selectively, fixably adjustable from a horizontal to a vertical position, and a slotted frame arm, said frame arm attached to said fixed and to said pivotal sections.

11. Floor and baseboard cleaning apparatus as claimed in claim 10 wherein said frame arm is arcuately shaped.

12. Floor and baseboard cleaning apparatus as claimed in claim 11 and including a hinge, said hinge joined to said fixed and said pivotal medium frame sections.

13. Floor and baseboard cleaning apparatus as claimed in claim 10 and including a spray assembly, said spray assembly including an electric pump, a switch, said switch connected to said pump, a liquid reservoir, said reservoir in fluid communication with said pump, and a nozzle, said nozzle in fluid communication with said pump whereby said switch will activate said pump and liquid will spray from said reservoir through said nozzle.

14. Floor and baseboard cleaning apparatus as claimed in claim 10 wherein said motor comprises a 110 v AC motor.

15. Floor and baseboard cleaning apparatus as claimed in claim 10 and including a universal joint, said universal joint connected to said handle and to said motor assembly to allow free handle movement.

* * * * *